US005123530A

United States Patent [19]

Lee

[11] Patent Number: 5,123,530

[45] Date of Patent: Jun. 23, 1992

[54] CIGARETTE CONTAINER

[76] Inventor: Kuen-Yi Lee, No. 350, Chunh-Shan Rd., Fang-Liao Hsiang, Ping-Tung Hsien, Taiwan

[21] Appl. No.: 755,130

[22] Filed: Sep. 5, 1991

[51] Int. Cl.[5] ..... B65D 85/10

[52] U.S. Cl. ..... 206/249; 206/252; 206/266

[58] Field of Search ..... 206/242, 249, 250, 251, 206/252, 253, 254, 255, 256, 265, 266, 267, 276

[56] References Cited

U.S. PATENT DOCUMENTS

| | | | |
|---|---|---|---|
| 1,724,735 | 8/1929 | Selbach | 206/256 X |
| 1,994,218 | 3/1935 | Hiering | 206/266 X |
| 2,303,859 | 12/1942 | Panzer | 206/252 X |
| 2,812,057 | 11/1957 | Brownfield | 206/250 |
| 3,033,419 | 5/1962 | Lebach | 206/252 X |
| 3,119,517 | 1/1964 | Adams | 206/252 X |
| 3,861,523 | 1/1975 | Fountain et al. | 206/267 X |
| 4,793,478 | 12/1988 | Tudor | 206/276 X |
| 4,850,481 | 7/1989 | Chern | 206/242 X |

FOREIGN PATENT DOCUMENTS

| | | |
|---|---|---|
| 390732 | 4/1933 | United Kingdom . |
| 438381 | 11/1935 | United Kingdom . |

*Primary Examiner*—Paul T. Sewell
*Assistant Examiner*—Jacob K. Ackun, Jr.
*Attorney, Agent, or Firm*—Poms, Smith, Lande & Rose

[57] ABSTRACT

A cigarette container comprising a body having a plurality of cigarette receivers therein, each receiver being in the form of a bore of substantially the same size as a cigarette, with a helical spring disposed on the lower end thereof, to respectively receive a cigarette therein, a cover which is releasibly secured on the body so as to be capable of being opened to deposit cigarettes into the cigarette receivers, and has a plurality of lids thereon, each of the lids covers a cigarette receiver and is slidable away from its position to allow a cigarette to be forced upward by one of the springs. A further bore is formed in the body to receive a plurality of granular breath refreshing pastilles therein and a dispensing device associated therewith is installed to control the dispensing of the pastilles.

3 Claims, 4 Drawing Sheets

CIGARETTE CONTAINER

FIELD OF THE INVENTION

The invention relates generally to a container for storing cigarettes and in particular to one having a mechanism to dispense cigarettes therefrom.

BACKGROUND OF THE INVENTION

Conventionally, cigarettes are sold in a paper container. This kind of packing, although convenient for selling and carrying, has disadvantages. One of the disadvantages is that cigarettes are often damaged when a conventional pack of cigarettes is placed in one's pocket because the paper container is incapable of bearing slightly larger pressure. Furthermore, water and sweat may wet and thus damage the cigarettes.

Although these are several cigarette containers which are made of much stronger materials, such as stones and plastics, and some of them are provided with a cigarette dispensing mechanism, they are intended for use indoors and especially for being disposed on a desk or a table. As a result, they are not fit for a person to carry.

OBJECTS OF THE INVENTION

Therefore, it is an object of the present invention to provide a pocket-sized container for depositing cigarettes therein which is strong enough to bear pressure so as to protect the cigarettes therein from being bent or crushed.

It is another object of the present invention to provide a pocket-sized container for depositing cigarettes therein to protect cigarettes from being water or sweat.

It is a further object of the present invention to provide a pocket-sized container for depositing cigarettes therein which is provided with a cigarette dispensing mechanism to feed out the cigarettes contained therein.

To achieve the above-mentioned objects, there is provided a cigarette container comprising a body having therein a plurality of cigarette receivers, in the form of a bore of substantially the same size as a cigarette with a helical spring disposed on the lower end thereof, to respectively receive a cigarette therein, a cover which is releasibly secured on the body so as to be capable of being opened to deposit cigarettes into the cigarette receivers, the receivers having a plurality of lids, each of the lids covers a cigarette receiver and is slidable so as to allow the cigarettes to be forced out of the receivers by the springs. A further bore is formed in the body to receive a plurality of granular breath refreshing pastilles therein, and a dispensing device associated therewith is installed to control the dispensing of the pastilles.

Other objects and advantages of the invention will be apparent from the following description of the preferred embodiment taken in connection with the accompanying drawings wherein:

DETAILED DESCRIPTION OF THE PREFERRED EMBODIMENT

Figure 1:
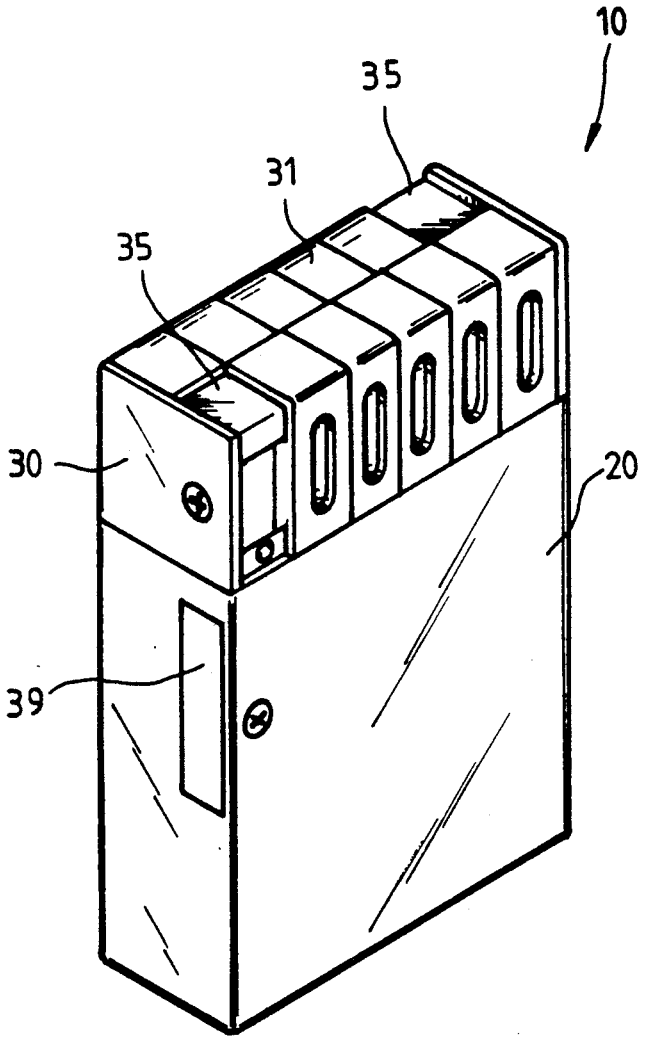
FIG. 1 is a perspective view of a cigarette container in accordance with the present invention.
Figure 2:
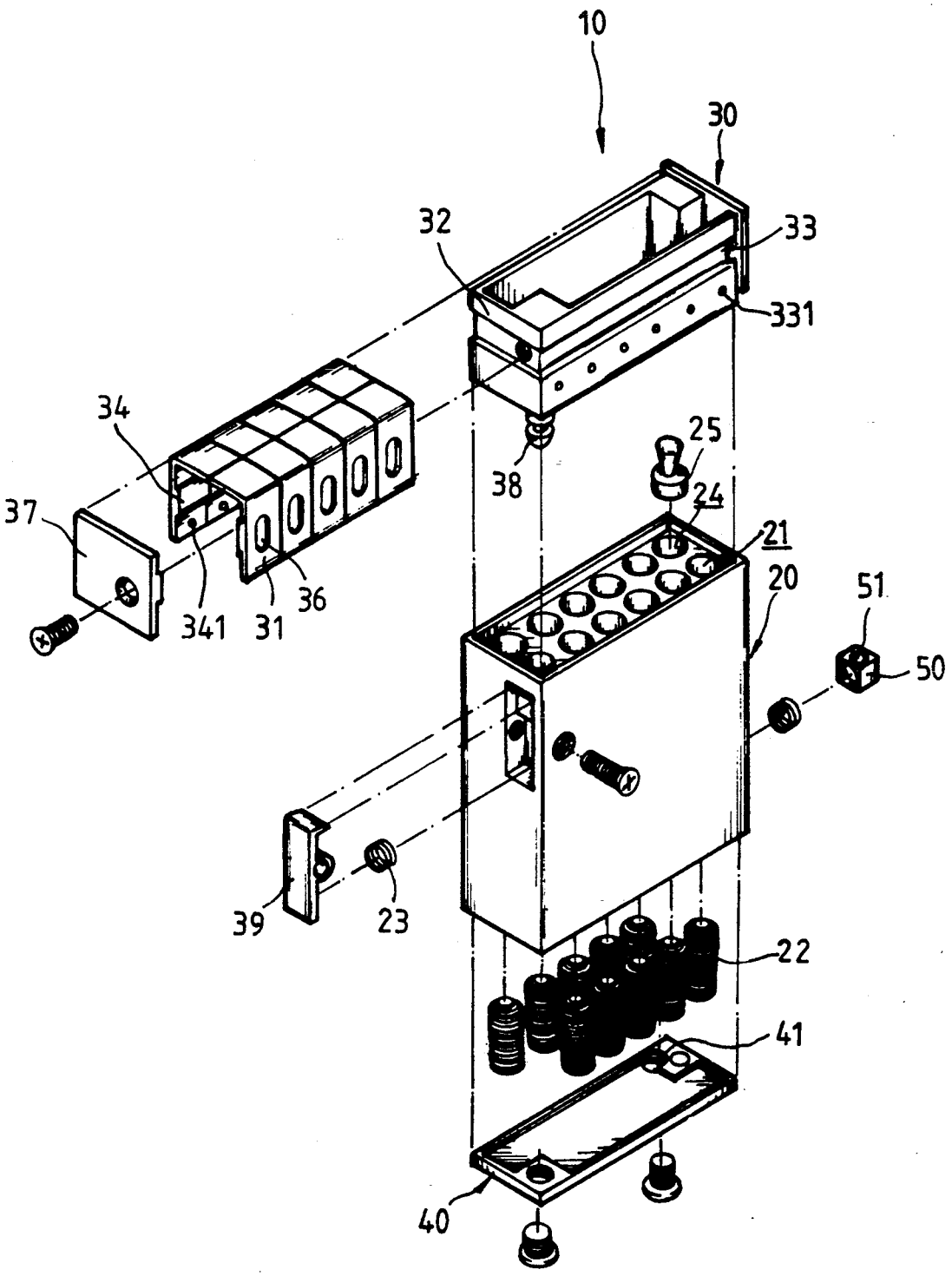
FIG. 2 is an exploded fragmentary view of the container shown in FIG. 1 to show the inside construction thereof.
Figure 3:
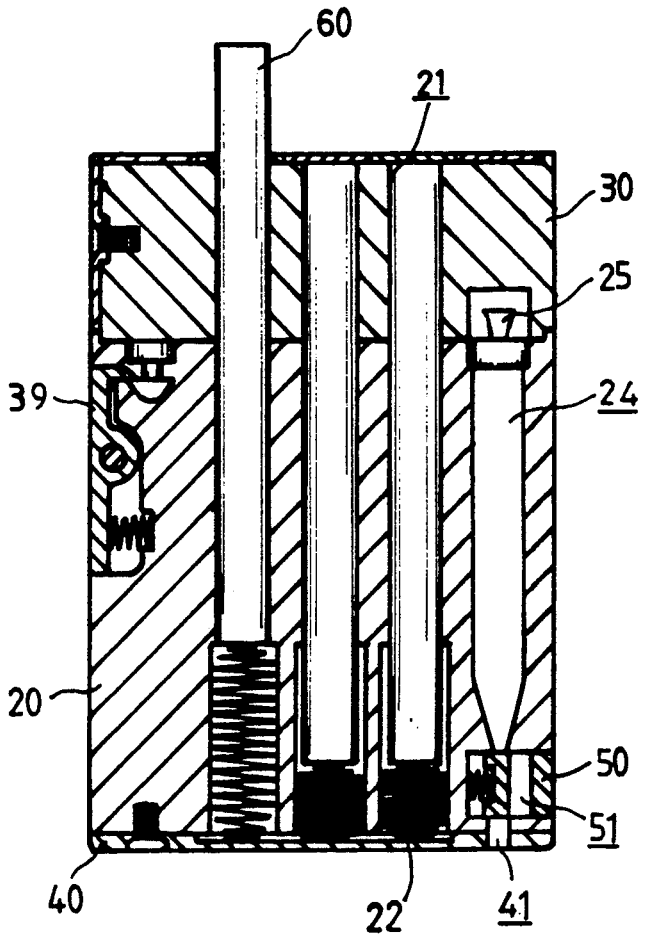
FIG. 3 is a cross-sectional view of the container shown in FIG. 1.

With reference to the drawings and in particular to FIGS. 1, 2, and 3, a cigarette container in accordance with the invention, generally designated by the reference numeral 10, comprises a body 20 having a plurality of cigarette receivers 21, therein each receiver 21 being in the form of a bore of substantially the same size as a cigarette running from a first end of the body to a second end thereof, and being to respectively receive a cigarette 60 therein, a cover 30 which is releasibly secured on the first end of the body and has a plurality of lids 31 (to be described hereinafter) slidably mounted thereon and a bottom 40 which is secured on the second end of the body.

The cover 30 has a rectangular frame 32 having two lateral sides and two longitudinal sides. A guiding slot 33 is formed on each of the longitudinal sides to guide the movement of the slidable lids 31. Each of the slidable lids 31 is an L-shaped element constituted by a base (a portion used to cover cigarettes 60 and keep them in position) and a stem (a portion used to guide the movement of the lids 31) with a projection 34 formed on the stem thereof. The L-shaped lids 31 are mounted on the rectangular frame 32 up-side-down with the projections 34 thereof received inside said guiding slots 33 and guided thereby. The size of the lids 31 is such that when two lids are respectively mounted on the slots of both longitudinal sides of the frame 31 and opposing each other, the bases thereof are just next to each other. When the longitudinal sides of the frame 32 are occupied by the lids, a space 35 is left as shown in FIG. 1. The space 35 is about the size of the lids 31 so as to allow each lid 31 to slide to a position next to its current position.

To facilitate moving the lids 31 along the longitudinal sides of the frame 32, a recess 36 is formed on the stem of each of the lids 31. The movement of the lids 31 is constrained within the extent of the frame 32 by a end plate 37 secured on the frame 32. To releasably secure the cover 30 on the body 20, a retaining means 38 is formed on the under side of the frame 32. The retaining means 38 has a recess which is engageable by a paw 39 (to be described hereinafter) secured on the body 20.

To facilitate positioning the lids 31, a boss 341 is formed on the stem of each lid 31 and an associated recess 331 is formed on the longitudinal sides of the frame 32.

In the body 20, a helical spring 22 is disposed in each of the cigarette receivers 21 so that when a cigarette 60 is disposed in one of the cigarette receivers 21, it protrudes out of the cover 30 partly to facilitate the withdrawal of the cigarette 60. The springs 22 are supported by the bottom 40 which is secured on the body 20. Each of the receivers 21 occupies a space coverable by one of the lids 31 so that when a cigarette is disposed in one of the receivers 21 and is pushed inward against the springs 22 to be completely received inside the container, it is covered by one of the lids 31 and kept therein by the lid 31.

The paw 39 is pivotally secured on the body 20 and biased by a spring 23 to catch the retaining means 38 of the cover 30.

Figure 4:
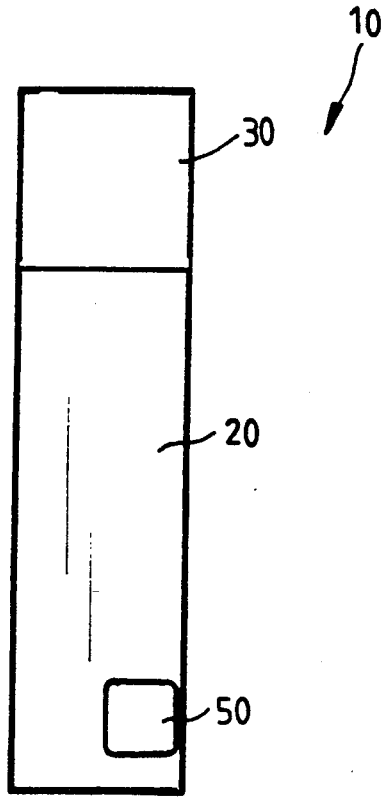
FIG. 4 is a side elevational view of the container shown in FIG. 1.
Figure 5:
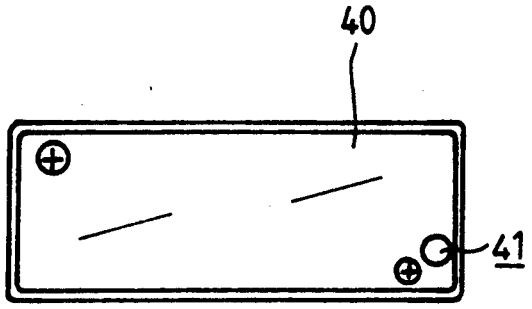
FIG. 5 is a bottom view of the container shown in FIG. 1.

A bore 24 is also formed in the body 20 for receiving therein granular breath refreshing pastilles (not shown). The bore 24 has a top end stopped by a stopper 25 and a narrowing lower end of decreasing cross-section to allow a pastille to pass therethrough. Dispensing the pastilles is controlled by a spring-biased block 50 (see FIGS. 3 and 4) which has a penetrating hole 51 serving as a passage for the pastilles when the block 50 is pushed inward against the biasing spring so that the hole 51 is in alignment with the bore 24. A hole 41 (see also FIG. 5) is formed onthe bottom 40 to allow the pastilles to drop down through hole 41 and out of the container 10.

It is apparent that although the invention has been described in connection with the preferred embodiment, it is contemplated that those skilled in the art may make changes to certain features of the preferred embodiment without altering the overall basic function and concept of the invention and without departing fromthe spirit and scope of the invention as described above and defined in the appended claims.

What is claimed is:

1. A cigarette container comprising:

a body having therein a plurality of cigarette receivers, each of said receivers being in the form of a bore of substantially the same size as a cigarette and having a helical spring disposed at a lower end thereof, each of said receivers being adapted to respectively receive one cigarette therein, said body being sized so that when said one cigarette is deposited in one of said cigarette receivers, a portion of said one cigarette protrudes out of said one receiver and may be pressed against said spring associated with said one receiver in order to dispose said one cigarette further get into said one receiver;

a bottom which is secured to said body in order to support said springs; and a cover which is releasably engaged to said body in order to allow said cigarettes to be deposited into said receivers, said cover comprising a frame having longitudinal sides, each of said longitudianl sides having a guiding slot formed therein and extending longitudinally therewith, said cover further comprising a plurality of lids, each of said lids having a covering portion and a guiding portion, said guiding portion having a projection complementary in shape with a corresponding one of said slots so that when said lids are installed on said frame said lids are guided so as to move along said slots, said covering portion of each of the lids covering a corresponding one of said cigarette receivers so that, after said one cigarette is pressed down against the spring associated therewith, said one cigarette is covered by said covering portion, said lids being slidable with respect to said slots so as to allow one of said receivers to be exposed and said one cigarette deposited therein forced out of the container by said spring;

said body having a compartment bore therein with a top end and a lower end, and a stopper removably engaged at said top end, said compartment bore adapted to contain a plurality of pieces of pastilles, and said lower end being of decreasing cross-section to allow one of said pieces of said pastilles to pass therethrough, said pastilles being dispensed from said container by a spring-biased block which has a penetrating hole formed therein so that when said block is pushed into said body so that said penetrating hole is in alignment with said lower end of said compartment bore, said one piece of the pastilles is allowed to drop out of said container via said penetrating hole and a hole formed in said bottom which is also in alignment with said lower end of said compartment bore.

2. A cigarette container as claimed in claim 1 wherein a recess is formed in the guiding portion of each of said lids to facilitate moving said lids along said slots.

3. A cigarette container as claimed in claim 1 wherein a boss is formed on the guiding portion of each of said lids and an associated recess is formed on the longitudinal sides of the frame so as to position said lids in a desired location.

* * * * *